US007559787B2

(12) United States Patent
Shigeta et al.

(10) Patent No.: US 7,559,787 B2
(45) Date of Patent: Jul. 14, 2009

(54) CONNECTOR HAVING A FEMALE CONNECTOR HOUSING AND A HOUSING COVER

(75) Inventors: Yoshinori Shigeta, Makinohara (JP); Akihiro Tsurata, Makinohara (JP); Takeshi Kazama, Makinohara (JP); Hiromasa Kubota, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/987,204

(22) Filed: Nov. 28, 2007

(65) Prior Publication Data

US 2008/0153341 A1 Jun. 26, 2008

(30) Foreign Application Priority Data

Dec. 22, 2006 (JP) ..... 2006-345907

(51) Int. Cl.
*H01R 13/627* (2006.01)

(52) U.S. Cl. ..... 439/358

(58) Field of Classification Search ..... 439/357, 439/358, 352
See application file for complete search history.

(56) References Cited

U.S. PATENT DOCUMENTS 5,938,470 A * 8/1999 Kashiyama ..... 439/489
6,419,515 B1 * 7/2002 Okayasu ..... 439/358
6,514,099 B2 * 2/2003 Endo ..... 439/489
6,821,139 B1 * 11/2004 Wu ..... 439/352
6,830,472 B1 * 12/2004 Wu ..... 439/358
6,902,432 B2 * 6/2005 Morikawa et al. ..... 439/607
7,056,142 B2 * 6/2006 Ueda ..... 439/358
7,131,855 B2 * 11/2006 Saitoh ..... 439/357
7,311,557 B2 * 12/2007 Oma et al. ..... 439/660
2001/0001750 A1 * 5/2001 Kawase et al. ..... 439/489
2003/0194899 A1 * 10/2003 Ueda ..... 439/357
2005/0130482 A1 * 6/2005 Saitoh ..... 439/357

FOREIGN PATENT DOCUMENTS

JP 2004-220970 8/2004

* cited by examiner

*Primary Examiner*—Neil Abrams
*Assistant Examiner*—Harshad C Patel
(74) *Attorney, Agent, or Firm*—Edwards Angell Palmer & Dodge LLP

(57) ABSTRACT

A flexible lock arm has a first arm which extends from a stay portion to an inflection point of the first arm on a front side of a terminal along a length direction indicated by arrow Y1 and a second arm which extends from the inflection point of the first arm to a rear end viewed from a stay portion. A first retaining projection is provided on the second arm.

4 Claims, 11 Drawing Sheets

CONNECTOR HAVING A FEMALE CONNECTOR HOUSING AND A HOUSING COVER

CROSS REFERENCE TO RELATED APPLICATIONS

This application is based on Japanese Patent Application No. 2006-345907, the contents of which are hereby incorporated by reference.

BACKGROUND OF THE INVENTION

1. Field of the Invention

This invention relates to a connector and, in particular, to a connector which includes a connector housing with a housing body having a terminal receiving chamber receiving thereinside a terminal, and a housing cover receiving the connector housing.

2. Description of the Related Art

Patent Document 1 (Japanese Patent Application Laid-Open Publication No. 2004-220970) discloses a conventional half-fitting preventing connector (see FIG. 14). The half-fitting preventing connector includes a female connector housing 100 as a housing connector with the terminal receiving chamber that receives a female terminal TF and the housing cover, i.e., a fitting detection member 200 that receives the female connector housing 100.

Unless the female connector housing 100 is in complete engagement with a mating male connector housing 300, the fitting detection member 200 does not allow the female connector housing 100 to be slid from an initial position where the female connector housing 100 still projects from a front opening of the fitting detection member 200 to an engagement-detection position where the entire female connector housing 100 is received in the fitting detection member 200. Whether or not the female connector housing 100 is completely engaged with the male connector housing 300 can be judged by whether the female connector housing 100 is positioned at the initial position or at the engagement-detection position.

The conventional female connector housing 100 has a main body 110, a flexible lock arm 120, and projections 130 configured to engage a pair of engaging portions formed at the fitting detection member 200. The main body, flexible lock arm, and projection in Patent Document 1 correspond to a housing main body, a first flexible lock arm, and a first retaining projection of the connector according to the present invention, respectively. The main body 110 is provided with the terminal receiving chambers that receive female terminals. The flexible lock arm 120 has a stay portion 121 upstanding from the main body 110, and an arm 122 which, when viewed from the stay portion 121, extends from the front end to the rear end of the female terminal TF along a length direction of the female connector housing 100. By virtue of this configuration, the flexible lock arm 120 is displaced in a seesaw-like manner about the stay portion 121 acting as a fulcrum. The projection 130 is provided to the rear end in the length direction when viewed from the stay portion 121 of the flexible lock arm 120.

The fitting detection member 200 has a cylindrical main body 210, an engaging portion 220, which corresponds to a second retaining projection of the present invention, and a flexible locking arm 230, which corresponds to a second flexible lock arm as a retention reinforcement portion of the present invention. The cylindrical main body 210 receives the female connector housing 100. The engaging portion 220 protrudes in the cylindrical main body 210 and engages the top end of the projection 130. By virtue of an engagement of the projection 130 and the engaging portion 220, the female connector housing 100 is detached from the fitting detection member 200 even when the fitting detection member 200 is displaced in a detachment direction, i.e., toward the rear end of the length direction Y1.

The flexible locking arm 230 abuts a front end of the arm 122. When the fitting detection member 200 is moved in the detachment direction, the front end of the arm 122 is flexibly deformed toward a lower side in the drawing. The rear end of the arm 122 is then flexibly deformed toward an upper side in the drawing, causing the projection 130 to be displaced toward the upper side in the drawing, i.e., in a direction in which the engagement with the engaging portion 220 is strengthened. In this manner, engagement is strengthened.

However, the conventional flexible lock arm 120 has a drawback: Since the deformation of the front side of the arm 122 is transmitted to the rear side of the arm 122 via the stay portion 121 slanting toward the front side of the arm 122, and a slant of a front side of the stay portion 121 is steeper than that of a rear side of the stay portion 121, the amount of deformation of the rear end of the arm 122 is therefore smaller than that of the front end of the arm 122. When a thickness of the stay portion 121 is made larger, the amount of deformation of the rear end of the arm 122 with respect to the front side of the arm 122 becomes smaller.

Also, since the connectors with reduced size and less height do not allow the front end of the arm 122 to be bent to a large extent, the conventional connectors fail to ensure sufficient engagement of the female connector housing 100 with the fitting detection member 200. As a result, the female connector housing 100 may be accidentally disengaged from the fitting detection member 200.

SUMMARY OF THE INVENTION

Hence, an object of the present invention is to provide a connector which allows firm engagement of a connector housing with a housing cover.

In order to attain the above objective, the present invention is to provide a connector that includes the connector housing and the housing cover the features of which are summarized as follows.

The connector housing includes a housing main body, a flexible lock arm, and a first retaining projection. The housing main body is provided with a terminal receiving chamber for receiving a terminal. The flexible lock arm is displaceable in a seesaw-like manner with a stay portion upstanding from the housing main body acting as a fulcrum. The first retaining projection is provided on a rear side in a length direction of the terminal when viewed from the stay portion of the flexible lock arm.

Meanwhile, the housing cover includes a cylindrical portion, a second retaining projection, and a retention reinforcement portion. The cylindrical portion receives the connector housing. The second retaining projection protruding from an inner surface of the cylindrical portion and engages a front side of the first retaining projection. The retention reinforcement portion displaces the first retaining projection toward an engagement direction in which the engagement of the first retaining projection with the second retaining projection is strengthened, by means of flexibly deforming the front end of the flexible lock arm when the cylindrical portion is moved toward a detachment direction in which the cylindrical portion is detached from the connector housing.

Further, the above flexible lock arm has a first arm which extends from the stay portion toward an inflection point of a front end of the terminal in the length direction, and a second arm that extends from the inflection point of the first arm toward a rear side viewed from the stay portion. Also, the first retaining projection is provided on the second arm.

With the construction described above, since the flexible lock arm has the first arm and the second arm which includes the first retaining projection, a rear end of the second arm can be flexibly deformed depending solely upon a deformation of a front end of the first arm, regardless of a difference of amounts of slanting of a front side and a rear side of the stay portion. Thus, more effective and reliable engagement of the connector housing with the housing cover can be achieved.

Preferably, the connector according to the present invention provides the connector housing including a fulcrum projection provided on a front side of the second arm when viewed from the stay portion which resides between the inflection point of the first arm and the first retaining projection. Also, the housing cover preferably has a supporting portion which supports a side of deformation of the fulcrum projection, caused by the retention reinforcement portion.

With the construction described above, since the connector housing has the fulcrum projection, and the housing cover has the supporting portion, the amount of deformation of the rear end of the second arm with respect to the amount of deformation of the front end of the first arm can be made larger. This is because the fulcrum projection on the front side viewed from the stay portion acts as a fulcrum when the front end of the flexible lock arm is flexibly deformed due to the retention reinforcement portion. Thus, more effective and reliable engagement of the connector housing with the housing cover can be achieved.

Preferably, the connector according to the present invention provides retaining surfaces of the first retaining projection and the second retaining projection, each of which is tapered, sloping in the engagement direction.

With the construction described above, since the retaining surfaces of the first retaining projection and the second retaining projection respectively are tapered, sloping in the engagement direction, the first retaining projection can be displaced more flexibly in the engagement direction. Thus, more effective and reliable engagement of the connector housing with the housing cover can be achieved.

These and other objects, features, and advantages of the present invention will become more apparent upon reading of the following detailed description along with the accompanied drawings.

DESCRIPTION OF THE PREFERRED EMBODIMENTS

Figure 1:
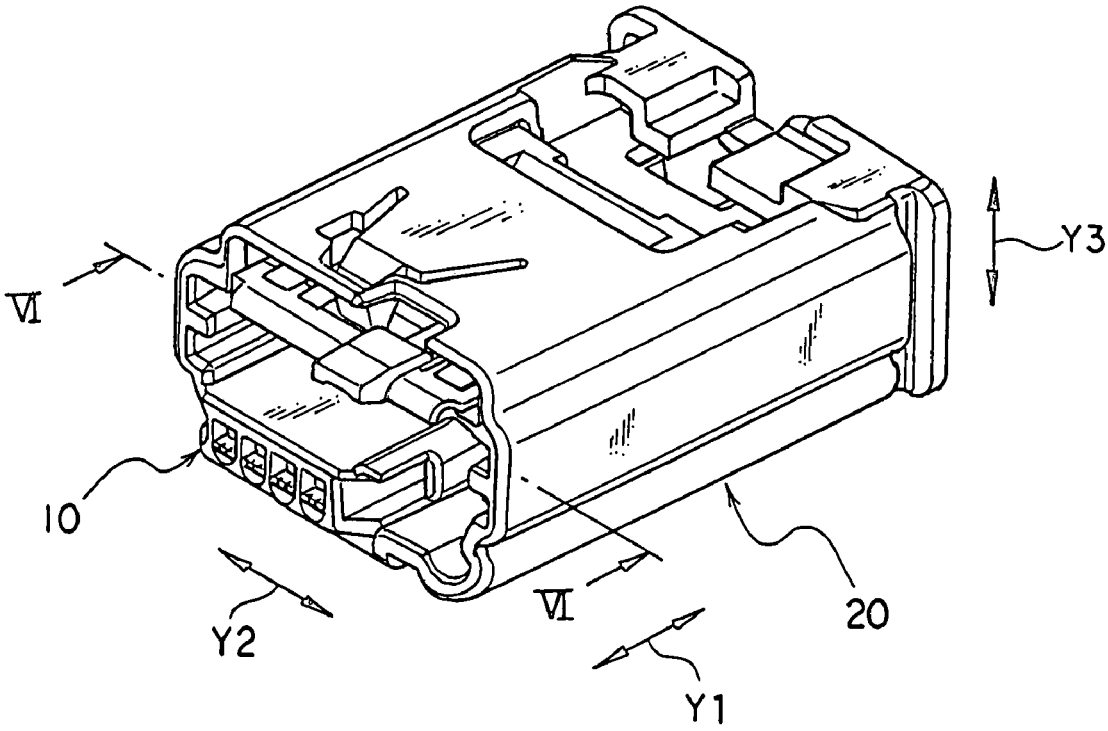
FIG. 1 is a perspective view of an embodiment of a connector in an initial position according to the present invention

An embodiment of the connector of the present invention is described with reference to the attached drawings 1 to 14. Note that arrows Y1, Y2, and Y3 in the drawings indicate length, width, and thickness directions of the connector, respectively.

Figure 2:
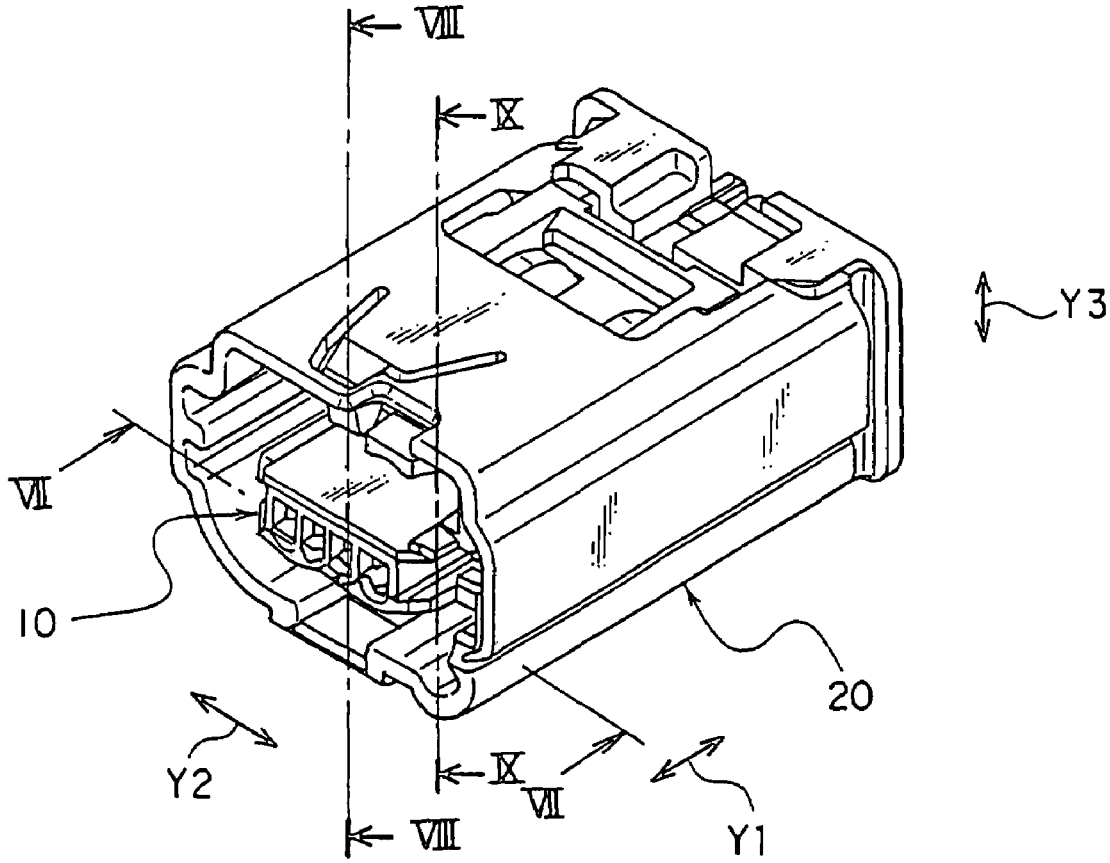
FIG. 2 is a perspective view of the connector of FIG. 1 in a complete engagement position.

Let us start with taking a look at FIGS. 1 and 2 to overview a configuration of the connector of the present invention. The connector has a connector housing 10, which is a female connector housing, and a housing cover 20 which receives the connector housing 10 thereinside. The housing cover 20 of this embodiment is an outer cover with connector position assurance (CPA) functionality, and has a similar function as in a conventional fitting detection member. When the connector housing 10 is not in complete engagement with a mating male connector housing, the connector housing 10 cannot be slid from an initial position (see FIG. 1) to a complete engagement position (see FIG. 2). As shown in FIGS. 1 and 2, respectively, the initial position of the connector housing 10 is a state where the connector housing 10 still projects from a front opening of the housing cover 20, and the complete engagement position is a state where the entire connector housing 10 has been received inside the housing cover 20.

Figure 3:
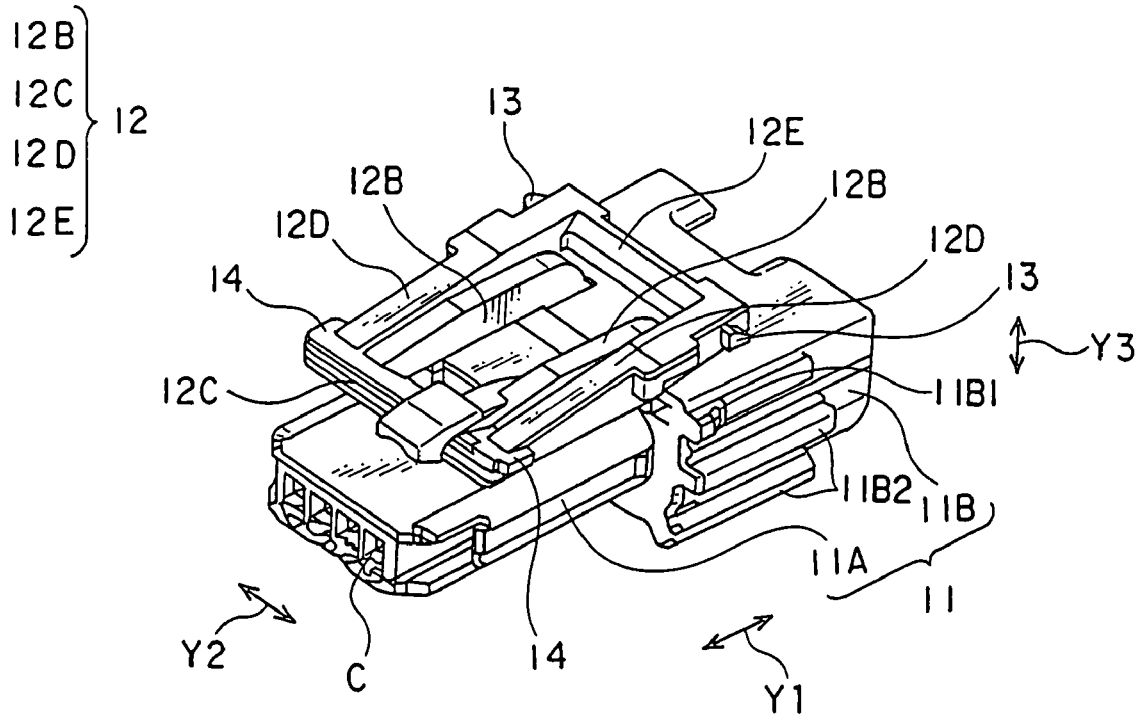
FIG. 3 is a perspective view of a female connector housing of the connector of FIG. 1.
Figure 5:
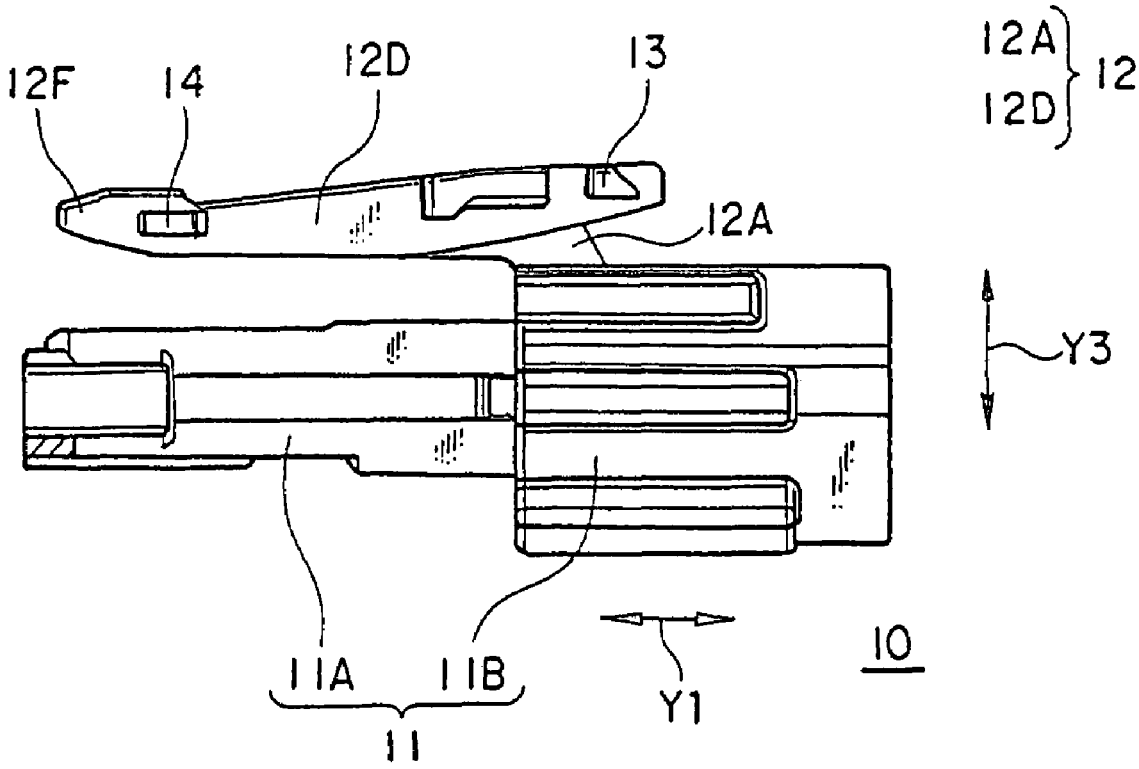
FIG. 5 is a side view of the female connector housing of FIG. 3.
Figure 9:
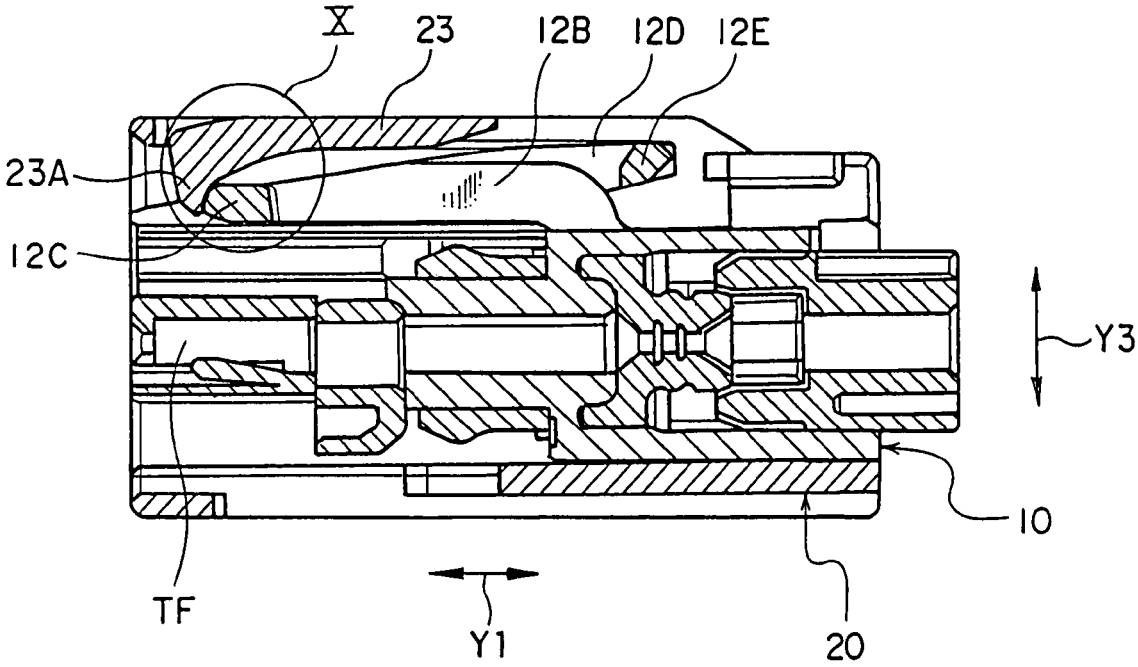
FIG. 9 is a cross-sectional view taken along the line IX-IX of FIG. 1.

Referring to FIGS. 3 and 5, the connector housing 10 has a housing main body 11 and a flexible lock arm 12. The housing main body 11 has a terminal receiving chamber C which receives a terminal TF (see FIG. 9). In the drawings, the four terminal receiving chambers are arranged along a width direction of the connector housing 10, indicated by arrow Y2 in the drawings. Arrow Y2 is orthogonal with respect to a length direction of the terminal TF, indicated by arrow Y1. The terminal TF is a female terminal.

The housing main body 11 includes a male housing retaining portion 11A provided to the front side of the female terminals TF along arrow Y1 and a housing cover engagement portion 11B provided to an opposing rear side of arrow Y1. The male housing retaining portion 11A engages the housing main body 11 with the male housing 30. The male housing 30 receives thereinside a mating male terminals which engage the female terminals TF. The housing cover engagement portion 11B engages the housing cover 20. The housing cover engagement portion 11B has a retaining claw 11B1 and a retaining projection 11B2. The retaining claw 11B1 is tapered so that a height of the retaining claw 11B1 gradually diminishes toward the rear end of arrow Y1. In the initial position, the retaining claw 11B1 engages a retaining claw 26 (see FIG. 6) provided on the housing cover 20. The retaining projection 11B2 projects along the length direction Y1. The retaining projection 11B2 engages a retaining projection 27 (see FIG. 7) provided on the housing cover 20 in the complete engagement position. Note that the front end of the terminal TF along the length direction Y1 is a side nearer to the male housing 30 while the rear end of the length direction Y1 is an opposite side of the front end, farther distant from the male housing 30.

Also, the flexible lock arm 12 is made of a flexible material. The flexible lock arm 12 has, as shown in FIGS. 3 and 5, a pair of stay portions 12A, a pair of first arms 12B, a connecting portion 12C, a pair of second arms 12D arranged alongside the pair of first arms 12B and a lock operating portion 12E.

The pair of the stay portions 12A upstands from the housing cover engagement portion 11B heightwise, i.e., along arrow Y3 representing the thickness direction. The thickness direction Y3 is at right angle to both the length direction Y1 and the width direction Y2. The pair of the first arms 12B extend from the pair of the stay portions 12A toward an inflection point provided on the front side of the length direction Y1. The pair of the first arms 12B are spaced with each other along the width direction Y2.

The connecting portion 12C engages the inflection points of the two first arms 12B. The connecting portion 12C, as shown in FIG. 11, has a tapering surface 12C1 on the connecting portion 12C. A height of the tapering surface 12C1 diminishes from the rear end toward the front end along the length direction Y1. Also, a tapering surface 12C2 is provided on an underside of the connecting portion 12C. A height of the tapering surface 12C2 diminishes from the rear end toward the front end along the length direction Y1.

The pair of the second arms 12D extend from the inflection points of the pair of the first arms 12B, along arrow Y1 toward the rear side viewed from the stay portion 12A. The lock operating portion 12E engages the rear ends of the pair of the second arms 12D with each other.

Figure 12A:
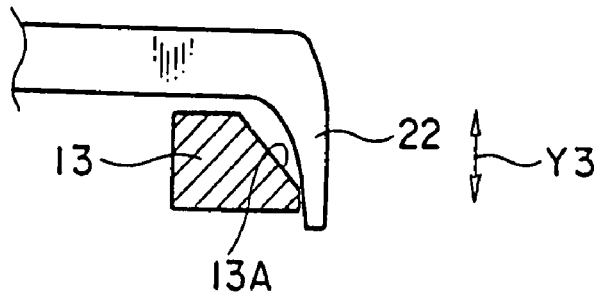
FIGS. 12A and 12B are partially sectional views of the female housing departing from the initial position of the housing cover and gradually approaching the complete engagement position of the housing cover.
Figure 12B:
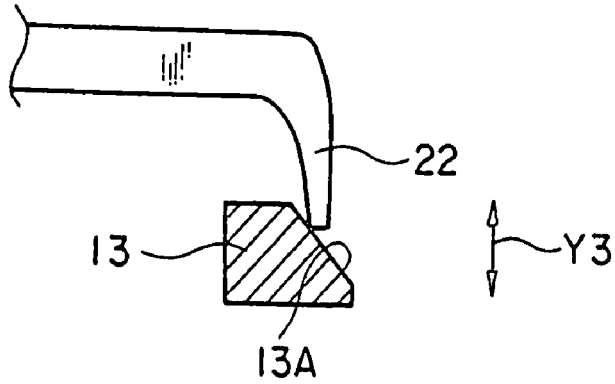

The connector housing 10 has a pair of first retaining projections 13 and a pair of fulcrum projections 14. The pair of the first retaining projections 13 engages a second retaining projection 22 provided on the housing cover 20. The pair of the first retaining projections 13 are, as shown in FIG. 5, closer to the rear end than the stay portion 12A of the pair of the second arms 12D are, and project outwardly along the width direction Y2. The pair of the first retaining projections 13, as shown in FIG. 12, has a tapering surface 13A on a rear side of the first retaining projections 13. A height of the tapering surface 13A diminishes from the front end toward the rear end along the length direction Y1.

Figure 8:
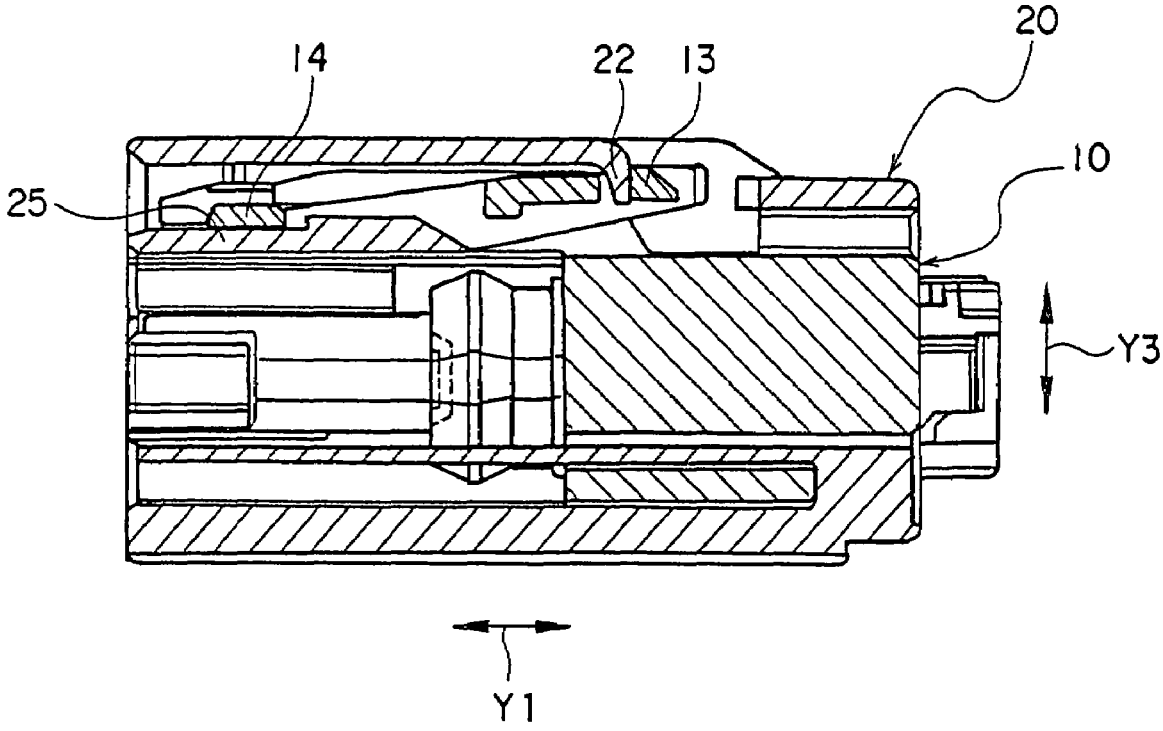
FIG. 8 is a cross-sectional view taken along the line VIII-VIII of FIG. 1.

As shown in FIG. 5, each one of the pair of the fulcrum projections 14 is provided on each corresponding one of the pair of the second arms 12D. The pair of the fulcrum projections 14 are arranged nearer to the front end of the connecting portion 12C than the stay portion which is yet nearer to the front end of the connecting portion 12C than the first retaining projection 13 is. As shown in FIG. 8, the pair of the fulcrum projections 14 are respectively arranged in such a manner that, in the complete engagement position, lower sides of the fulcrum projections corresponding to a lower side of the thickness direction Y3 are supported by a pair of supporting portions 25 provided on the inner wall of the housing cover 20.

With the above configuration of the flexible lock arm 12, the connecting portion 12C can be lifted toward an upper side of the thickness direction Y3 with the stay portion 12A acting as a fulcrum when the lock operating portion 12E is pushed toward a bottom side of the thickness direction Y3. Likewise, the lock operating portion 12E and the first retaining projection 13 are lifted toward the upper side of the thickness direction Y3 with the fulcrum projection 14 acting as a fulcrum when the connecting portion 12C is pushed toward the bottom side along the thickness direction Y3.

Figure 4:
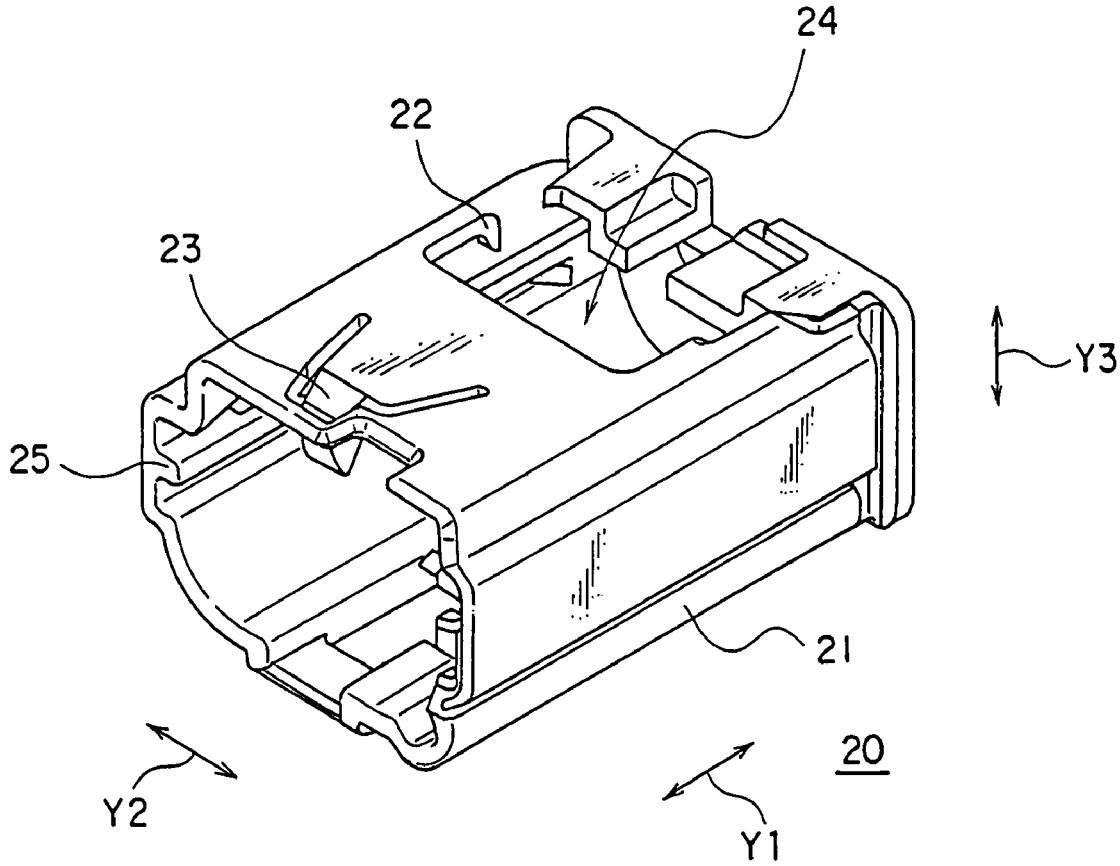
FIG. 4 is a perspective view of a housing cover of the connector of FIG. 1.
Figure 6:
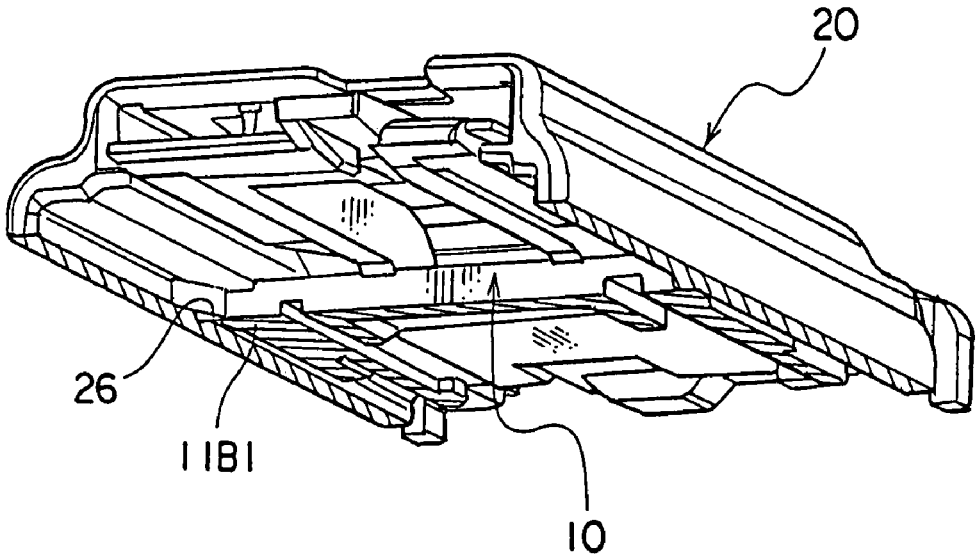
FIG. 6 is a cross-sectional perspective view taken along the line VI-VI of FIG. 1.
Figure 7:
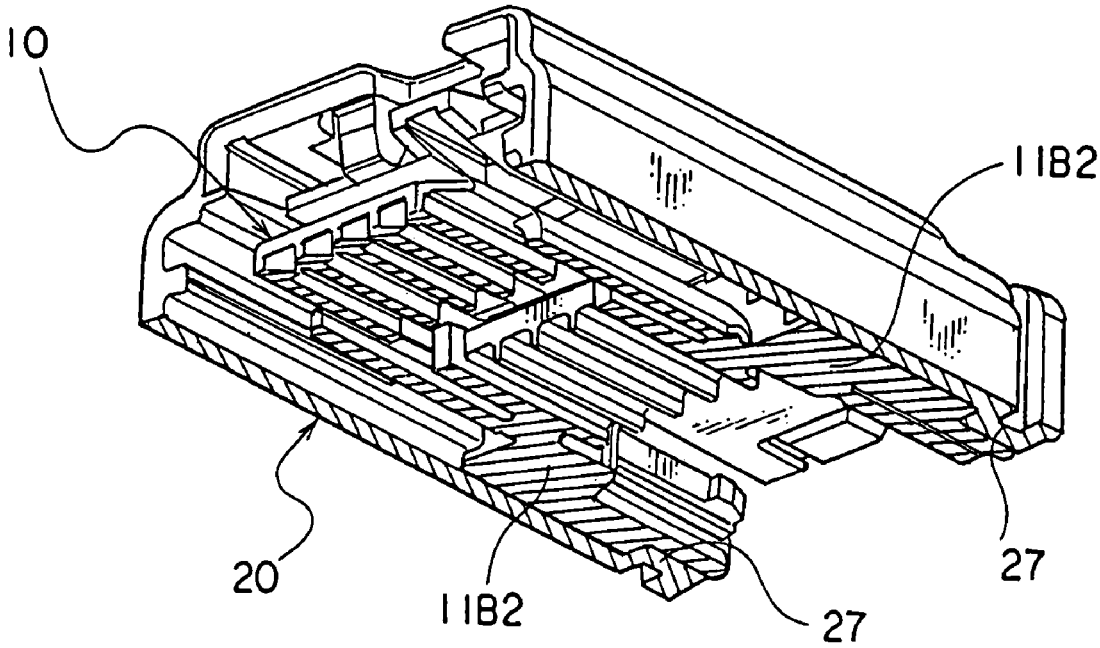
FIG. 7 is a cross-sectional perspective view taken along the line VII-VII of FIG. 2.

Secondly, the following describes a configuration of the housing cover 20. Referring to FIG. 4, the housing cover 20 has a cylindrical portion 21, a second retaining projection 22, a retention reinforcement portion 23, an opening 24, and a supporting portion 25. The cylindrical portion 21, formed in a cylindrical shape, receives thereinside the connector housing 10. As shown in FIGS. 6 and 7, a retaining claw 26 and a retaining projection 27 are provided on an inner wall of the cylindrical portion 21. The retaining claw 26 is tapered so that a height of the retaining claw 26 gradually diminishes from the rear end toward the front end along the length direction Y1. The retaining claw 26 engages the retaining claw 11b1 provided in the housing 10. In the complete engagement position, the retaining projection 27 engages a retaining projection 11B2 provided in the connector housing 10. The second retaining projection 22, as shown in FIG. 8, protrudes in the cylindrical portion 21 and, in the complete engagement position, engages the top end of the first retaining projection 13. Incidentally, the flexible lock arm 12 and the retention reinforcement portion 23 may be referred to as a first flexible lock arm and a second flexible lock arm, respectively, if functional correspondence is to be emphasized.

The retention reinforcement portion 23 is provided along the length direction Y1, wherein a region of the retention reinforcement portion 23 corresponding to the rear end along the length direction Y1 is supported, and a region of the retention reinforcement portion 23 corresponding to the front end along the length direction Y1 is a free end. A retaining claw 23A protruding toward the connector housing 10 is provided at a front end of the retention reinforcement portion 23. The retaining claw 23A of the retention reinforcement portion 23 abuts the front end of the connecting portion 12C inside the housing cover 20 when the connector housing 10 is in the complete engagement position. The retaining claw 23A, as shown in FIG. 11, has a tapering surface 23A1 to the rear end of the retaining claw 23A. The tapering surface 23A1 becomes nearer to a lower side in the drawing as the tapering surface 23A1 approaches the front end along the length direction Y1.

Referring again to FIG. 2, an opening 24 is provided in such a manner that a lock operating portion 12E of the connector housing 10 is exposed to outside of the housing cover 20 via the opening 24 when the connector housing 10 is in the complete engagement position inside the housing cover 20. As shown in FIG. 8, the supporting portion 25 in the complete engagement position supports the bottom side of the connector housing 10 corresponding to the lower end of the thickness direction Y3.

The male housing 30 has a projecting claw 31 projecting toward the upper side of the thickness direction Y3. Further, a tapering surface 31A is provided on a rear end of the projecting claw 31. The tapering surface 31A approaches the upper side in the drawing as the tapering surface 31A approaches the front end along arrow Y1 representing the length direction.

Third, the following describes how to insert the connector housing 10 into the housing cover 20. To start with, the rear end of the connector housing 10 is inserted via the opening on a front side of the housing cover 20 into the housing cover 20. After that, the connector housing 10 is moved toward the rear end along the length direction Y1 and, when the connector housing 10 has reached the initial position, the retaining claw 11B1 of the connector housing 10 engages the retaining claw 26 of the housing cover 20 (see FIG. 6). Thus, the connector housing 10 will be firmly maintained at the initial position even when the connector housing 10 is pulled toward the front end of the housing cover 20 along the length direction Y1.

Figure 11A:
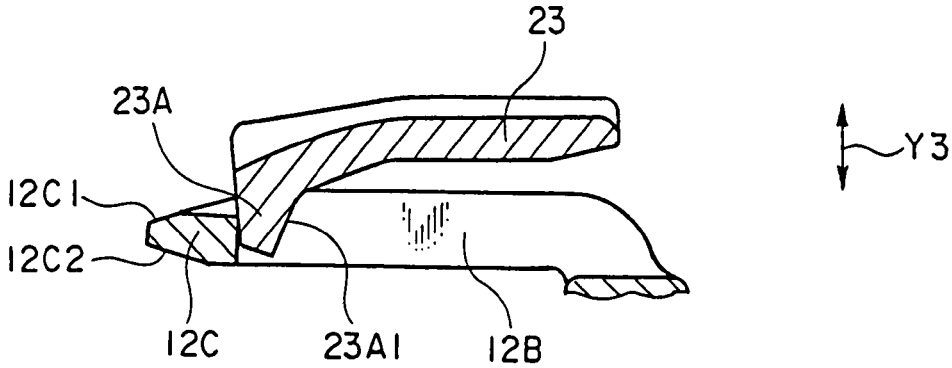
FIG. 11A is a partially sectional view of the connector at the initial position.
Figure 11B:
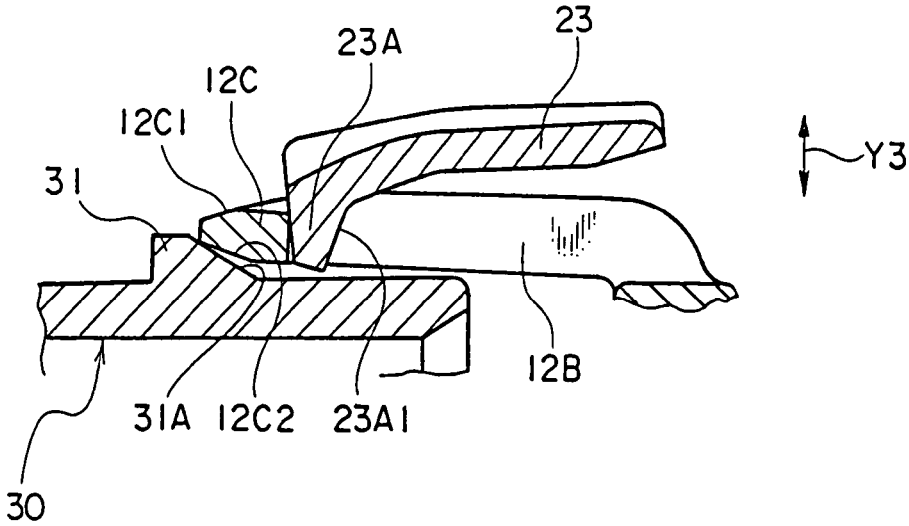
FIG. 11B is a partially sectional view of the female housing and the mating male housing in a state of incomplete engagement.
Figure 11C:
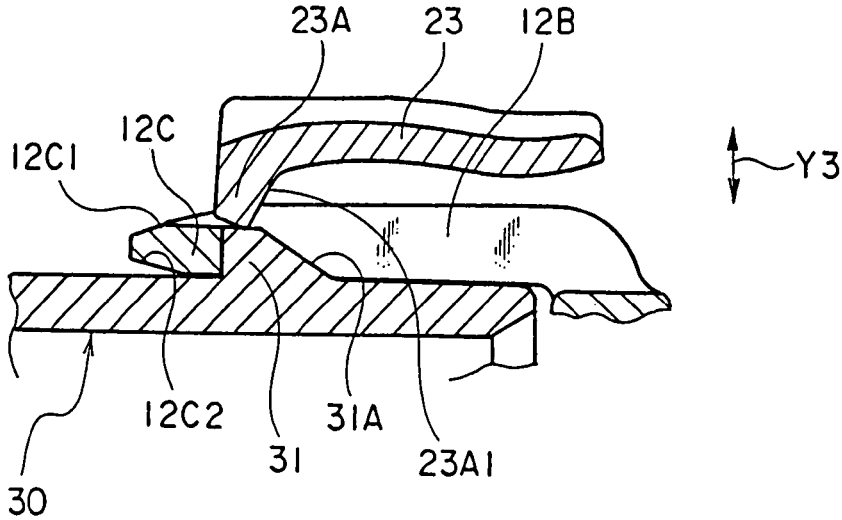
FIG. 11C is a partially sectional view of the female housing and the mating male housing in a state of complete engagement.

Further referring to FIG. 11A, when the connector housing 10 is in the initial position, the retaining claw 23A of the retention reinforcement portion 23 engages the rear end of the connecting portion 12C. Thus, the connector housing 10 is effectively kept in the initial position even when the connector housing 10 is pushed toward the rear end of the connector housing 20 along the length direction Y1.

Fourth, an engagement mechanism for engaging the connector housing 10 with the mating male housing 30 is as follows. The male housing 30 is moved toward the connector housing 10 while the connector housing 10 is in the initial position. When the top end of the projecting claw 31 on the male housing 30 reaches the connecting portion 12C, the projecting claw 31 gradually pushes the connecting portion 12C of the flexible lock arm 12 upwardly along the mutually opposing tapering surfaces 12C2 and 31A, thus strengthening the engagement of the connecting portion 12C of the flexible lock arm 12 with the retention reinforcement portion 23 (see FIG. 11B). The connector housing 10 remains in the initial position in such an incompletely engaged state.

When the male housing 30 is inserted further until the projecting claw 31 reaches the rear side viewed from the connecting portion 12C, the flexible lock arm 12 is restored to an original shape and the connector housing 10 becomes completely engaged with the male housing 30. At this point, the projecting claw 31 pushes up the retention reinforcement portion 23 toward the upper side in the drawing, and disengages the connecting portion 12C of the flexible lock arm 12 from the retention reinforcement portion 23 (see FIG. 11C). In this manner, the connector housing 10 can be inserted further into a deeper rear end inside the housing cover 20.

Next, the connector housing 10 completely engaging the male housing 30 is further moved toward the deeper rear end inside the housing cover 20. When the first retaining projection 13 of the connector housing 10 reaches the second retaining projection 22 of the housing cover 20, the second retaining projection 22 gradually pushes the first retaining projection 13 on the flexible lock arm 12 downwardly along the tapering surface 13A of the first retaining projection 13 (see FIGS. 12A and 12B).

Figure 10:
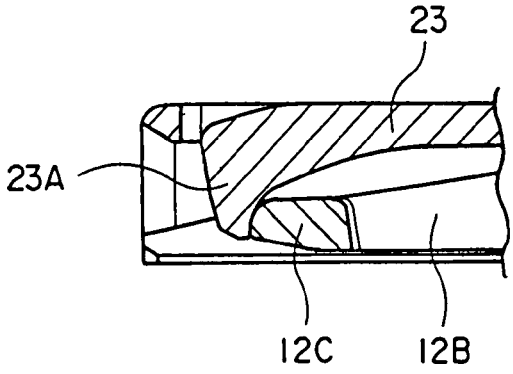
FIG. 10 is an enlarged view of the circle X of FIG. 9.

When the connector housing 10 is moved toward a further deeper rear end inside the housing cover 20 until the connector housing 10 reaches the complete engagement position, then, as shown in FIG. 8, the first retaining projection 13 is located at a rear side viewed from the second retaining projection 22 and the first retaining projection 13 is restored to an original shape. Thus, the second retaining projection 22 engages the top end of the first retaining projection 13, and the connector housing 10 is kept in the complete engagement position even when the connector housing 10 is pulled toward the front end of the housing cover 20 along the length direction Y1. Also, when the connector housing 10 is in the complete engagement position, the retaining projection 11B2 of the connector housing 10 engages the retaining projection 27 of the housing cover 20, and the connector housing 10 is held in the complete engagement position even when the connector housing 10 is pushed toward the rear end of the housing cover 20 along the length direction Y1 (see FIG. 7). In addition, when the complete engagement position is reached, the retaining claw 23A of the retention reinforcement portion 23 abuts the top end of the connecting portion 12C (see FIG. 10).

From the foregoing it is clear that, when the first retaining projection 13 is displaced toward the lower side by pushing the lock operating portion 12E downwards, a state of engagement of the second retaining projection 22 with the first retaining projection 13 can be exited. In other words, a movement in a direction from the upper side toward the lower side of arrow Y3 will cause the state of the engagement to be exited, and a movement in a direction from the lower side toward the upper side of arrow Y3 will cause the state of the engagement to be strengthened.

Finally, the following explains the operations of each part when, in the complete engagement position, a force is applied which may cause detachment of the connector housing 10 from the housing cover 20. When the housing cover 20 is displaced, without operating the lock operating portion 12E, along the length direction Y1, i.e., toward a detachment direction in which detachment of the housing cover 20 from the connector housing 10 results, then the retention reinforcement portion 23 gradually pushes down the connecting portion 12C of the flexible lock arm 12 along the retaining claw 23A of the retention reinforcement portion 23 and the taper surfaces 23A1 and 12C1 of the connecting portion 12C, toward the lower side in the drawing.

Since the retention reinforcement portion 23 is supported by the fulcrum projection 14 and the supporting portion 25, a rear side viewed from the fulcrum projection 14 is lifted up toward the upper side in the drawing when the connecting portion 12C is pushed down. In this manner, the first retaining projection 13 is pushed up toward the upper side, i.e., in an engagement direction in which the engagement of the first retaining projection 13 with the second retaining projection 22 is strengthened, and an engagement margin between the second retaining projection 22 of the housing cover 20 and the first retaining projection 13 of the connector housing 10 is widened, thus improving a holding power.

According to the above connector, the flexible lock arm 12 has the first arm 12B which extends from the stay portion 12A toward the inflection point on the front side of the terminal TF along arrow Y1, and the second arm 12D which extends from the inflection point of the first arm 12B toward the rear side when viewed from the stay portion 12A. Also, the first retaining projection 13 is provided on the second arm 12D. This configuration allows the rear end of the second arm 12D to be deformed flexibly depending solely upon the deformation of the front end of the first arm 12B, regardless of the difference between the amounts of slanting of the front side of the stay portion 12A and the rear side of the stay portion 12A. This helps reinforce the engagement of the first retaining projection 13 with the second retaining projection 22.

In addition, according to the connector described above, the connector housing 10 has the fulcrum projection 14 provided on the second arm 12D which is closer to the front end than the stay portion 12A residing between the inflection point of the first arm 12B and the first retaining projection 13, and the housing cover 20 has the supporting portion 25 which supports the side of deformation caused by the retention reinforcement portion 23 of the fulcrum projection 14, i.e., the lower side of the thickness direction Y3. When the front end of the flexible lock arm 12 is flexibly deformed toward the lower side by the retention reinforcement portion 23, the fulcrum projection 14 acts as a fulcrum and the amount of deformation of the rear end of the second arm 12D is augmented with respect to the amount of deformation of the front end of the first arm 12B, thus strengthening the engagement of the first retaining projection 13 with the second retaining projection 22.

Although the above embodiment includes the fulcrum projection 14 and the supporting portion 25 that are provided on the connector housing 10 and the housing cover 20, respectively, implementation is possible without these two features.

Figure 13A:
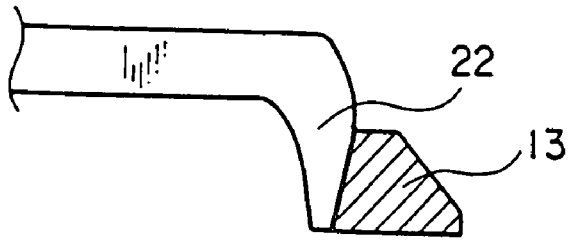
FIGS. 13A and 13B respectively show a first retaining projection and a second retaining projection in another embodiment.
Figure 13B:
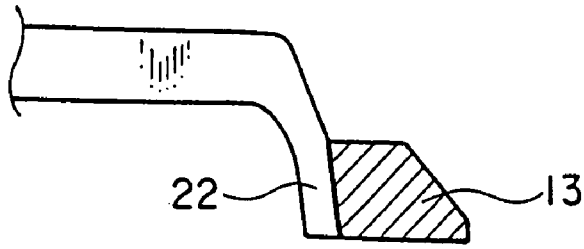
Figure 14:
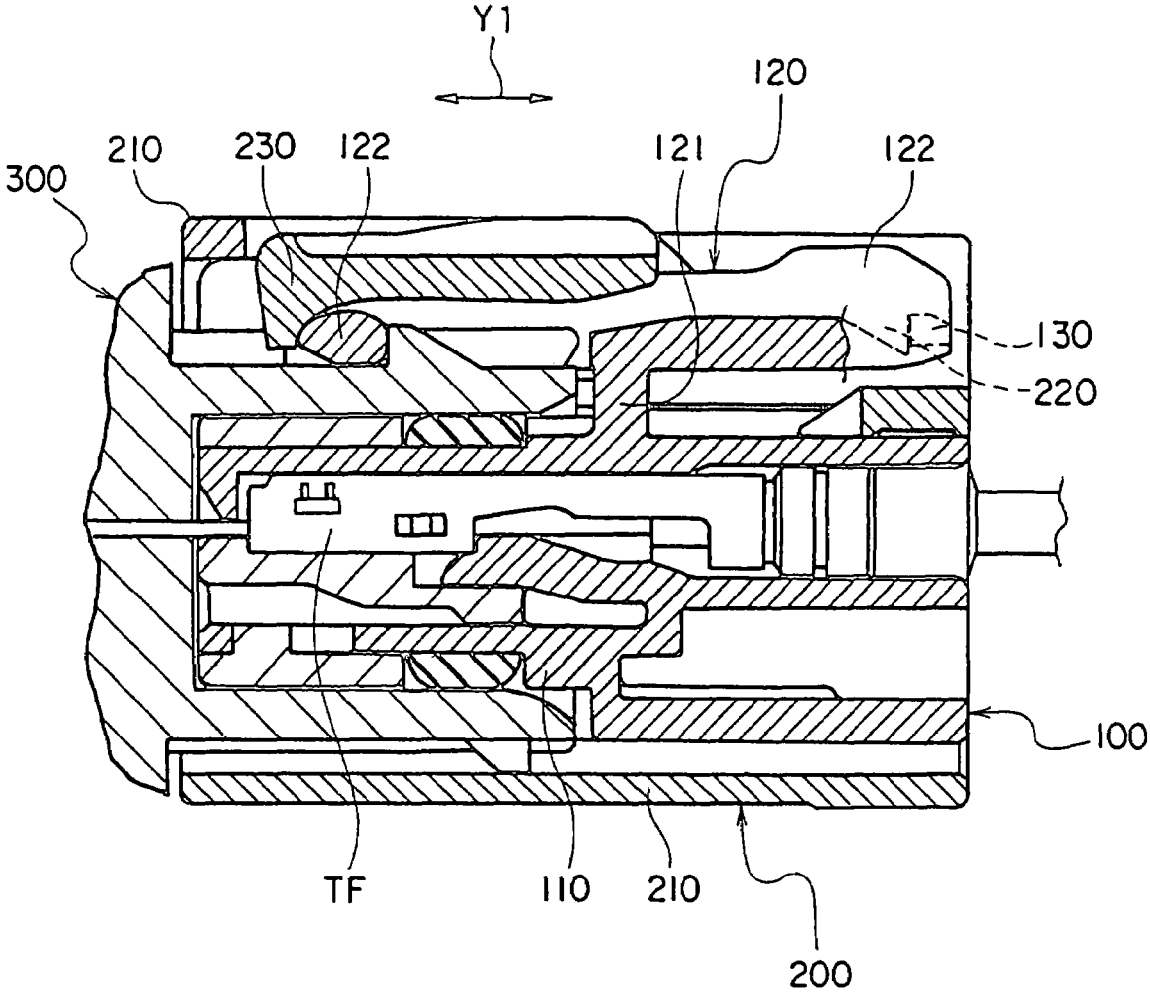
FIG. 14 PRIOR ART
FIG. 14 is a cross-sectional view illustrating an example of a conventional half-fitting preventing connector.

Also, the retaining surfaces of the first retaining projection 13 and the second retaining projection 22 are in parallel with respect to each other in the thickness direction Y3. This does not exclude other possibilities of implementation. For example, as shown in FIGS. 13A and 13B, mutually opposing retaining surfaces that are tapered, in order to facilitate lifting up of the first retaining projection 13, would allow the first retaining projection 13 to be displaced more smoothly in the engagement direction.

It should be noted that the embodiment described above is illustrated as an example of the possible embodiments of the present invention and that numerous modifications and variations can be effectuated within the spirit and scope of the present invention.

What is claimed is:

1. A connector comprising:

a connector housing including a housing main body having a terminal receiving chamber for receiving a terminal, a flexible lock arm displaceable in a seesaw-like manner with a stay portion upstanding from said housing main body acting as a fulcrum, and a first retaining projection arranged on a rear side of a length direction of said terminal viewed from said stay portion of said flexible lock arm; and a housing cover including a cylindrical portion receiving said connector housing, a second retaining projection protruding from an inner surface of said cylindrical portion and engaging a front side of said first retaining projection, and a retention reinforcement portion flexibly deforming a front end of said flexible lock arm and displacing said first retaining projection toward an engagement direction in which engagement of said first retaining projection with said second retaining projection is strengthened, upon an occurrence of a movement of said cylindrical portion toward a detachment direction in which said cylindrical portion is detached from said connector housing, wherein said flexible lock arm includes a first arm which extends from said stay portion to an inflection point on a front side of said terminal in the length direction, and a second arm which extends from the inflection point of said first arm to a rear side of said stay portion and arranged alongside said first arm, and said first retaining projection is provided on said second arm.

2. A connector as set forth in claim 1, wherein said connector housing includes a fulcrum projection provided on a front side of said second arm when viewed from said stay portion residing between the inflection point of said first arm and said first retaining projection, and said housing cover includes a supporting portion which supports a side of deformation of said fulcrum projection caused by said retention reinforcement portion.

3. A connector as set forth in claim 1, wherein a retaining surface of said first retaining projection and a retaining surface of said second retaining projection are both tapered, sloping toward said engagement direction.

4. A connector as set forth in claim 2, wherein a retaining surface of said first retaining projection and a retaining surface of said second retaining projection are both tapered, sloping toward said engagement direction.

* * * * *